US005877462A

United States Patent [19]

Chenais

[11] Patent Number: 5,877,462

[45] Date of Patent: Mar. 2, 1999

[54] SAFETY EQUIPMENT FOR MULTIMOBILE ELEVATOR GROUPS

[75] Inventor: Patrick Chenais, Bern, Switzerland

[73] Assignee: Inventio AG, Hergiswil NW, Switzerland

[21] Appl. No.: 728,955

[22] Filed: Oct. 11, 1996

[30] Foreign Application Priority Data

Oct. 17, 1995 [CH] Switzerland ..... 02935/95

[51] Int. Cl.[6] ..... B66B 9/00

[52] U.S. Cl. ..... 187/249; 187/382

[58] Field of Search ..... 187/249, 288, 187/350, 391, 380, 382

[56] References Cited

U.S. PATENT DOCUMENTS

| | | | |
|---|---|---|---|
| 4,989,695 | 2/1991 | Kubo | 187/101 |
| 5,419,414 | 5/1995 | Sakita | 187/391 |
| 5,464,072 | 11/1995 | Muller | 187/249 |
| 5,482,143 | 1/1996 | Saito | 187/394 |
| 5,663,538 | 9/1997 | Sakita | 187/382 |

FOREIGN PATENT DOCUMENTS

| | | |
|---|---|---|
| 0595122 | 5/1994 | European Pat. Off. . |
| 5051185 | 3/1993 | Japan . |
| 63-016383 | 11/1994 | Japan . |
| 2217046 | 10/1989 | United Kingdom . |
| 9218411 | 10/1992 | WIPO . |

*Primary Examiner*—Kenneth Noland

*Attorney, Agent, or Firm*—MacMillan, Sobanski & Todd, LLC

[57] ABSTRACT

With this safety equipment in a multimobile elevator group, collisions between cars (C1 . . . CN) operating in the same shaft (1) can be prevented. For this purpose, each car (C1 . . . CN) is equipped with a safety module (10). In order not to cause any collision in the case of a stop command of a car (C1 . . . CN), the safety module (10) must know the positions and speeds of the other cars (C1 . . . CN) at all times. A decision module (12) integrated into the safety module (10) processes the travel data received by way of the communications system (11) and decides whether a car (C1 . . . CN) may or may not stop. Furthermore, the decision module (12) determines the braking behavior of a car (C1 . . . CN) (normal stop, emergency stop or triggering of the car-catching device).

9 Claims, 5 Drawing Sheets

SAFETY EQUIPMENT FOR MULTIMOBILE ELEVATOR GROUPS

BACKGROUND OF THE INVENTION

The present invention relates generally to safety equipment for elevators and, in particular, to safety equipment for a multimobile elevator group, which prevents collisions between several elevators operating in one shaft.

A elevator plant with several shafts, in which several vertically and horizontally automotive passenger transport equipments can operate in the same shaft, has become known from the European patent application EP 0 595 122 (U.S. Pat. No. 5,464,072). Each car can travel horizontally from one shaft to another shaft and is provided with an individual drive, for example with a friction wheel drive, the friction and guide wheels of which roll along in the shaft corners. Each car furthermore comprises an independent control for the management of the car calls or destination calls, for which purpose the distance from a car, which is possibly situated above or below, is measured. Moreover, a conventional car-catching device is provided at the lifting carriage of the car as protection against excess speed or in the case of crash.

In the case of the afore-described equipment, only safety equipments for excess speed or faulty operation of a car are provided. In the case of an emergency stop or also for a normal floor stop of a car, it cannot be ensured whether further cars, which are situated above or below in the same shaft, can still stop in time in order to avoid a collision.

SUMMARY OF THE INVENTION

The invention is based on the object of proposing a safety equipment for a multimobile elevator group of the initially mentioned kind, which equipment prevents collisions between cars situated in the same shaft.

The advantages achieved by the invention are to be seen substantially in that the performance capability of the multimobile elevator group can be exploited fully by an optimal adaptation of the spacings between the cars with the aid of the safety equipment and that the safety module is constructed to be redundant so that the elevator installation does not have to depend on only a single safety module.

Advantageous developments and improvements in the safety equipment indicated in claim 1 for a multimobile elevator group are given by the measures recited in the subclaims. The safety equipment is particularly suitable for automotive cars. Furthermore, due to the arrangement of a safety module at each car, other cars, for example one following in the same shaft, can be monitored and trigger an emergency stop when a faulty function occurs at the monitored car.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
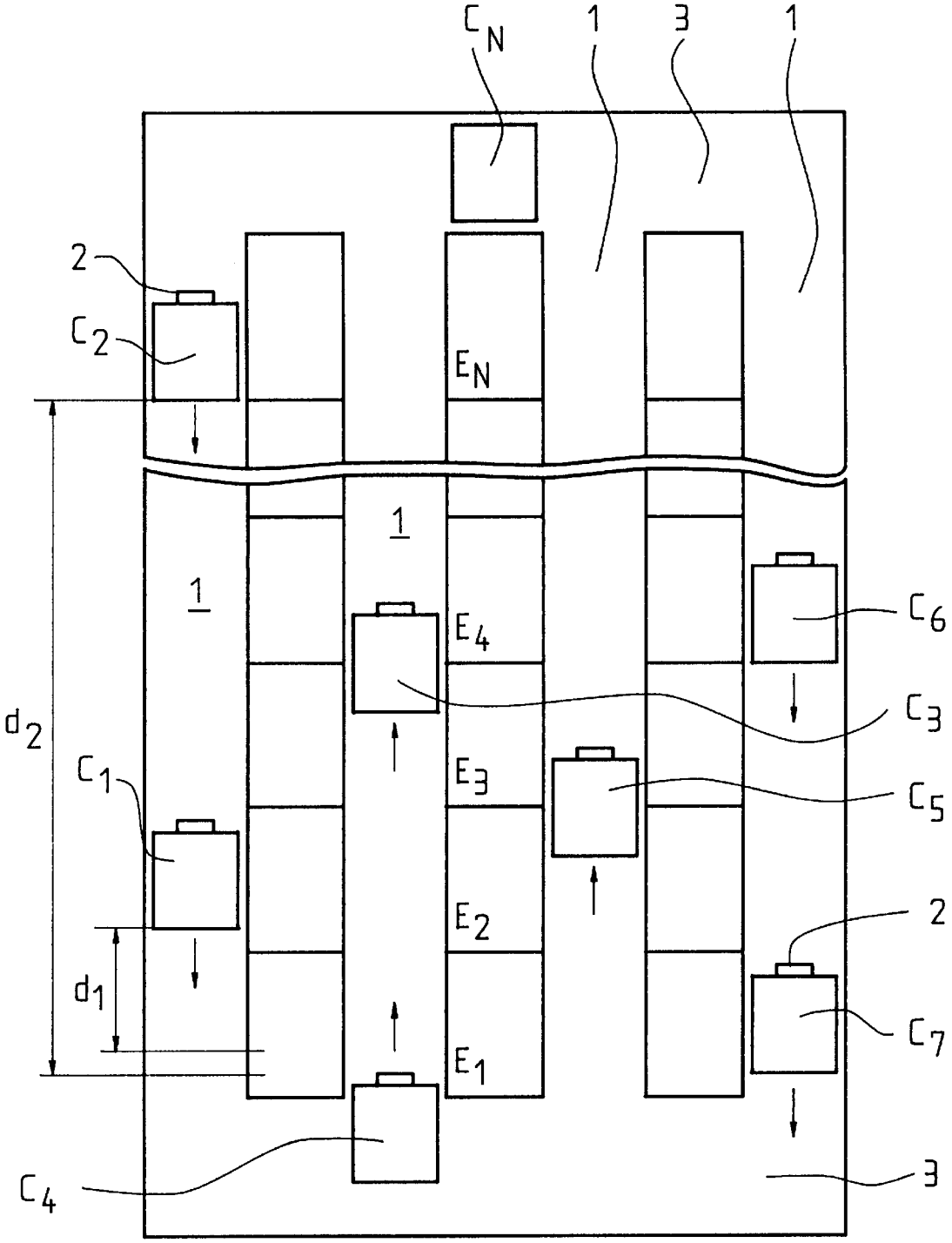
FIG. 1 is a schematic illustration of a multimobile elevator plant in accordance with the present invention.

FIG. 1 shows a schematic illustration of a multimobile elevator installation. Several vertically and horizontally automotive elevator cars C1 . . . CN operate in a elevator plant with, for example, four shafts 1 and the floors E1 . . . EN. Each car C1 . . . CN is driven by an own independent drive 2, for example by a frequency-regulated drive. The construction can take place in, for example, the form of the friction wheel drive described in EP 556 595. Several cars C1 . . . CN can move independently upwards or downwards in each shaft 1. The shafts 1 are each connected together at their upper and lower ends by a respective connecting passage 3. In this manner, the cars C1 . . . CN can change their direction of travel by a change of shaft. A change in the direction of travel can likewise take place when only one car C1 . . . CN is situated in a shaft 1.

In conventional elevator groups, the emergency stop and the engagement of the carcatching device are the two basic principles in the case of excess speed or faulty operation. In a multimobile elevator group as shown in FIG. 1, several cars C1 . . . CN can operate in the same shaft 1 at the same time. In such a elevator group, a safety equipment must ensure that collisions between the cars C1 . . . CN can be prevented in the case of excess speed or faulty operation.

In the case of an emergency stop or on engagement of the car-catching device, the cars C1 and C2, for example, need the respective distances d1 and d2 as braking travels. A collision between the two cars C1 and C2 would occur if the spacing amounts to d2–d1 at the beginning of the braking phase.

Equally, possibilities of collisions exist in normal operation of the elevator group:

Call allocation to a car; when a floor call is allocated to, for example, the car C1, this must stop at the desired floor and service the call. In the case of such a situation, it must be taken into consideration that the following car C2 does not cause any collision without impairing the normal operation. According to the spacing between both the cars and the duration of the stop of the car C1, a reduction in the speed of the car C2 can suffice or, however, it must likewise stop, for example at a higher floor.

Horizontal transfer of cars C1 . . . CN; during the horizontal travel of cars in the connecting passages 3, collisions with cars travelling vertically in the shafts 1 must be avoided.

In order to be able to prevent the afore-described possibilities of collisions, the operational states of all cars C1 . . . CN operating in the elevator group must be known. The stopping strategy in the case plays an essential part in the case of multimobile elevator groups. The decisive aspects are the safety and the performance capability of the elevator plant. Too great a safety spacing between the cars C1 . . . CN reduces the performance capability and thus the advantages of a multimobile elevator plant by comparison with a conventional elevator installation. Moreover, collisions cannot be prevented by a great spacing on its own.

Figure 2:
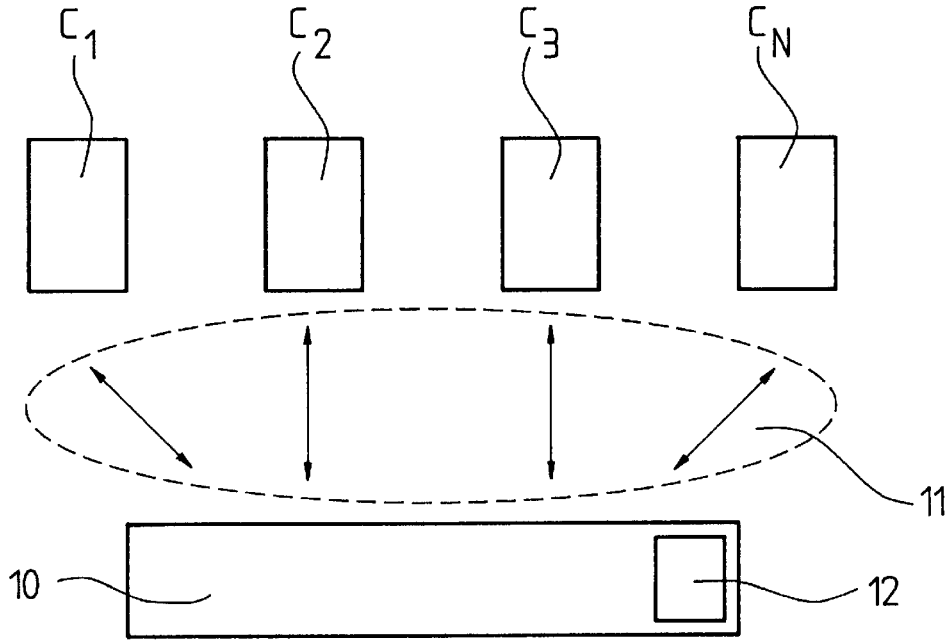
FIG. 2 is a schematic illustration of the elevator cars with the safety equipment of the apparatus in FIG. 1.

FIG. 2 shows a schematic illustration of the elevator cars C1 . . . CN with a safety module 10. In order not to cause any collision in the case of a stop command for a car C1 . . . CN, the positions and speeds of each car C1 . . . CN in the multimobile elevator group must be known to the safety module 10 at all times. This safety module 10 must be able to decide the necessary braking behavior (characteristics of the retardation curve, kind of the braking) instantaneously for each car C1 . . . CN by reference to these travel data. A communications system 11 secures the information transmission between the elevator cars C1 . . . CN and the safety module 10. The safety equipment furthermore contains a decision module 12, which is responsible for the determination of the stop commands, within the safety module 10. The decision module 12 continuously receives the positions, speeds and stop possibilities from all cars C1 . . . CN. The cars C1 . . . CN moreover send a stop request, which the decision module 12 processes and grants the stop permission to the car C1 . . . CN.

The decision module 12 can decide at any time to brake or stop a car. It also decides whether a car C1 . . . CN may or may not stop in response to a stop request. Furthermore, the decision module 12 determines the manner of the stopping:

normal stop, emergency stop or triggering of the car-catching device.

The normal stop is regulated, for example in a frequency-regulated drive, by way of the torque. In the case of an emergency stop and for securing of the car C1 . . . CN in the case of a stop at a floor E1 . . . EN, a drum brake for example is used as stopping brake. The car-catching device arranged directly at the car can be constructed as, for example, roller-catching device. The decision and the manner as well as also the location of the stop is communicated to the car from the decision module 12.

On the basis of the actual travel data, the safety module 10 can also permit different directions of travel to the cars C1 . . . CN in the same shaft 1 without causing collisions. This travel operation increases the efficiency of the elevator group substantially.

A continuous data flow with the positions, speeds and destinations of the cars C1 . . . CN would need an infinite communications channel. For this reason, a dynamic elevator model is integrated into the safety module 10. This model permits a very rapid transmission of travel data (positions, speeds and travel destinations) and enables the decision module 12 to make an immediate determination and communication of the stop command to the cars C1 . . . CN. The destination floor allocation is so restricted that unnecessary stops and cars C1 . . . CN blocked between the floors E1 . . . EN are avoided.

Figure 3:
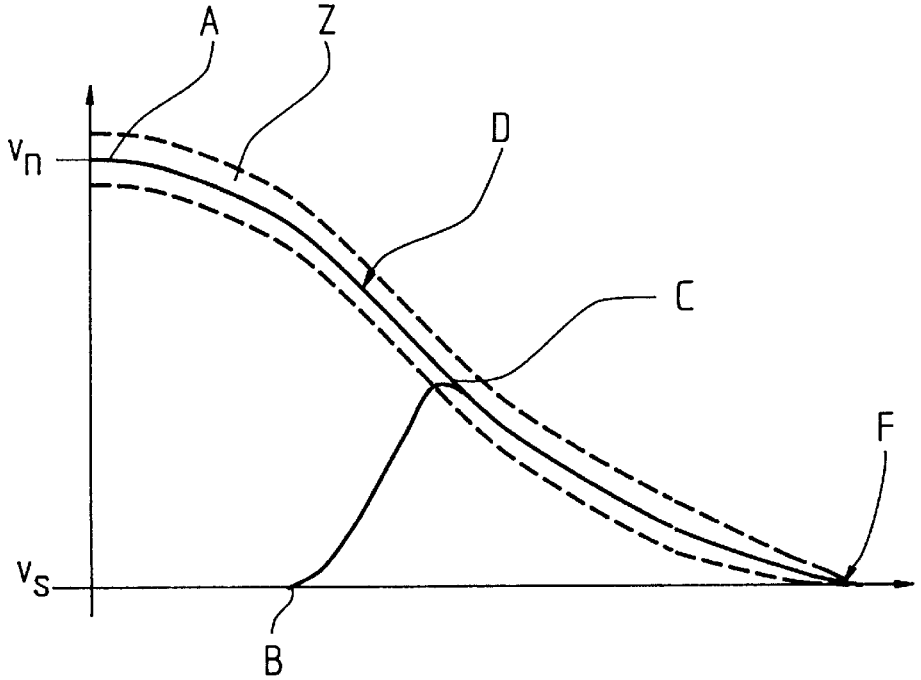
FIG. 3 is a retardation curve for elevator cars.

FIG. 3 shows a retardation curve D for elevator cars C1 . . . CN. A car C1 travels through the shaft 1 at the nominal speed $v_n$. In order to be able to stop at a certain floor E1 . . . EN, the drive control follows the preset retardation curve D within a certain tolerance band Z from the beginning of the retardation with the nominal speed $v_n$ at the point A to standstill $v_s$ of the car C1 at the desired floor E1 . . . EN at the point F of the retardation curve D. When the car C1 starts from a point B lying nearer to the point F, it cannot be accelerated to the nominal speed $V_n$, since the car C1 can otherwise no longer be brought to standstill by means of retardation values reasonable for the passengers. Thus, the drive control on reaching point C follows the retardation curve D to standstill $v_s$ at the point F.

Figure 4:
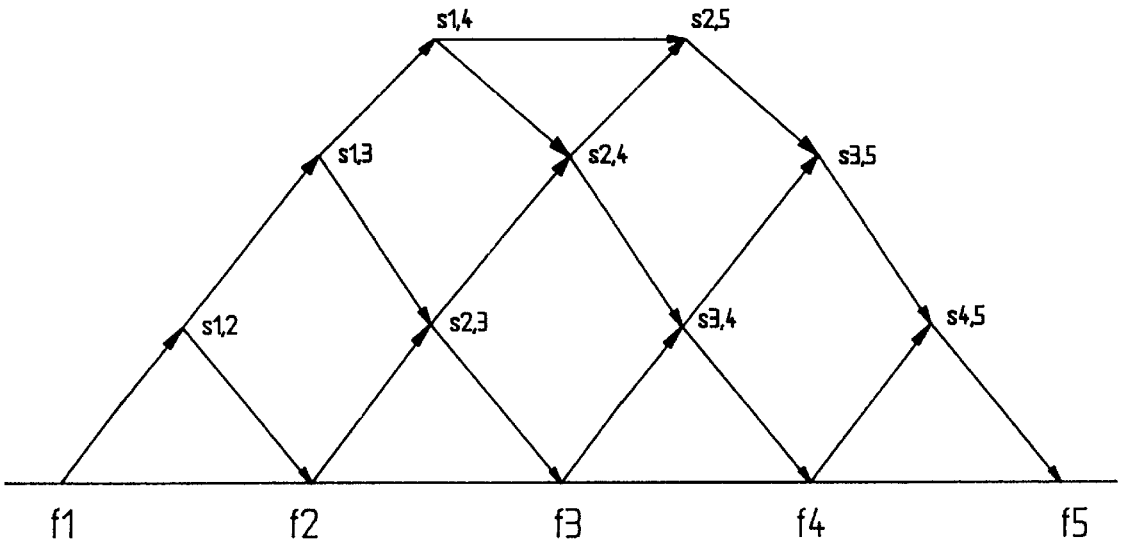
FIG. 4 is a model of the elevator travel curves.

FIG. 4 shows a dynamic model of the elevator travel curves for a building with five floors f1 to f5. According to the retardation curve D shown in FIG. 3, the travel curves for all possible floor distances, accelerations and retardations are illustrated in the dynamic model. Selectors s i,j are the intersections between the acceleration curves from the start floors I and the retardation curves to the destination floors j. The point f k is the stopping position on floor k. The information from all selectors s and stopping positions f and the transition time between these points form the dynamic model of a elevator plant.

The knowledge of the position of a relevant point of a car C1 . . . CN in the network is tantamount to knowledge of the instantaneous positions and speeds. This permits the determination of the future positions and the stopping possibilities of the cars C1 . . . CN. For that reason, a car C1 . . . CN need only indicate the position of a certain mark in the network in order to be able to transmit all information data demanded by the decision module.

Such a communication can take place in, for example, the following manner:

! 365.4 C1 s3,4.

This communication makes it known that car C1 will reach the selector s3,4 at the time 365.4. The exclamation mark ! declares the communication as information. The manner of coding of the communication can be freely chosen and adapted to the communications system 11.

Figure 5:
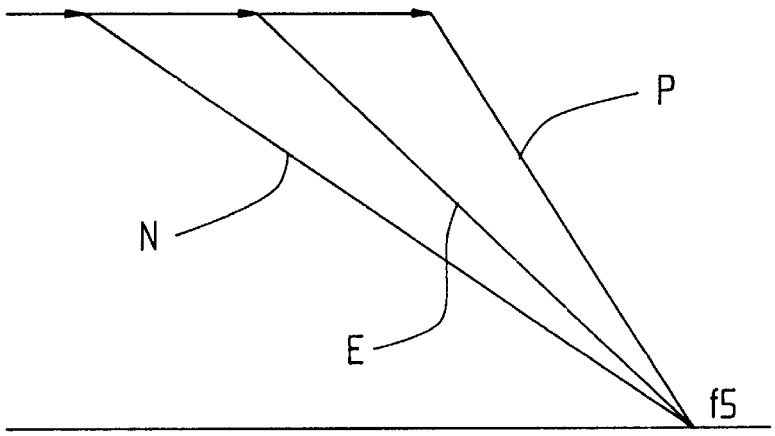
FIG. 5 is a schematic illustration of the possible braking behavior and the stop commands for a car.

FIG. 5 shows a schematic illustration of the possible braking behavior and the stop commands of a car. The simple and rapid sending of the stop commands takes place through the decision module 12. As most important components, the command must contain the stopping position f k in the network, which the car C1 . . . CN must reach.

A stop command can take place for example in the following form:

!! 370.1 C1 f5.

This stop command instructs the car C1 to reach the floor f5. The double exclamation mark !! indicates that a stop command is concerned. The time indication 370.1 is optional. It corresponds to the maximum arrival time at floor f5. Thereby, the braking behavior is fixed implicitly (normal stop N, emergency stop E and car-catching device P).

There are also other possibilities of forming the stop commands. For example, it can be indicated which of the braking behaviors shown in FIG. 5 must be followed. Example:

!! 370.1 C1 f5 [E].

The additional formation [E] describes the braking behavior, in this case an emergency stop E, in order to be able to stop the car C1 at the floor f5.

The stop commands are fixed implicitly. The decision module 12 can arrange a stop for a car C1 . . . CN long before the arrival at a selector f k. The decision module 12 is therefore detached from any real time problems, such as, for example, the commands for the brakes and so forth. Each car C1 . . . CN is responsible for the monitoring of its position and speed. Equally, the cars C1 . . . CN are themselves responsible for the initiation of the braking phase or for the retardation control to the final stop, for which the stop command sent from the decision module 12 is complied with.

Figure 6:
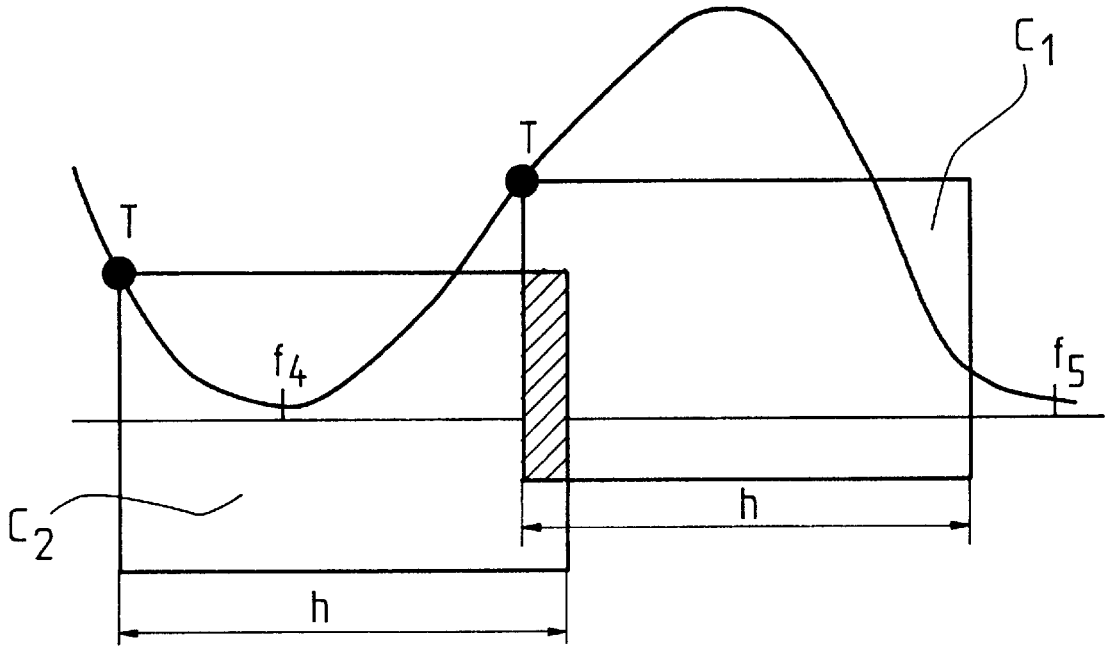
FIGS. 6 and 7 are a schematic illustration of the car states for the decision module.
Figure 7:
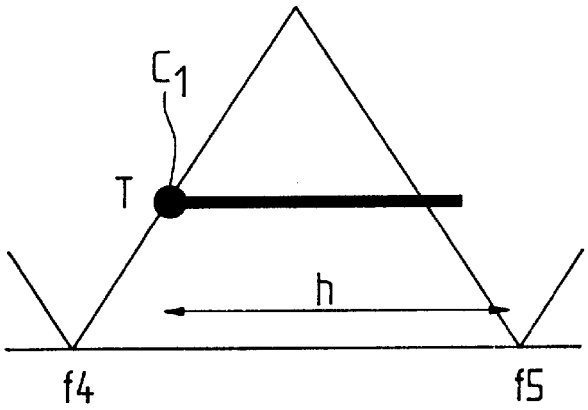

FIGS. 6 and 7 show schematic illustrations of the car states for the decision module 12. The decision module 12 must know the dimensions of the cars C1 . . . CN, in particular their heights h, for the monitoring of the elevator installation. The car height h is taken into consideration by the decision module 12 as length of the bar shown in FIG. 7. Marks T represent the states of the cars C1 . . . CN in the network. A configuration as in FIG. 6 would cause a collision of the two cars C1 and C2 by reason of the overlapping (hatched region) between the car C2 in approach to floor f4 and car C1 on the departure from floor f4. Such system states can be predicted and effectively prevented by the decision module 12.

Figure 8:
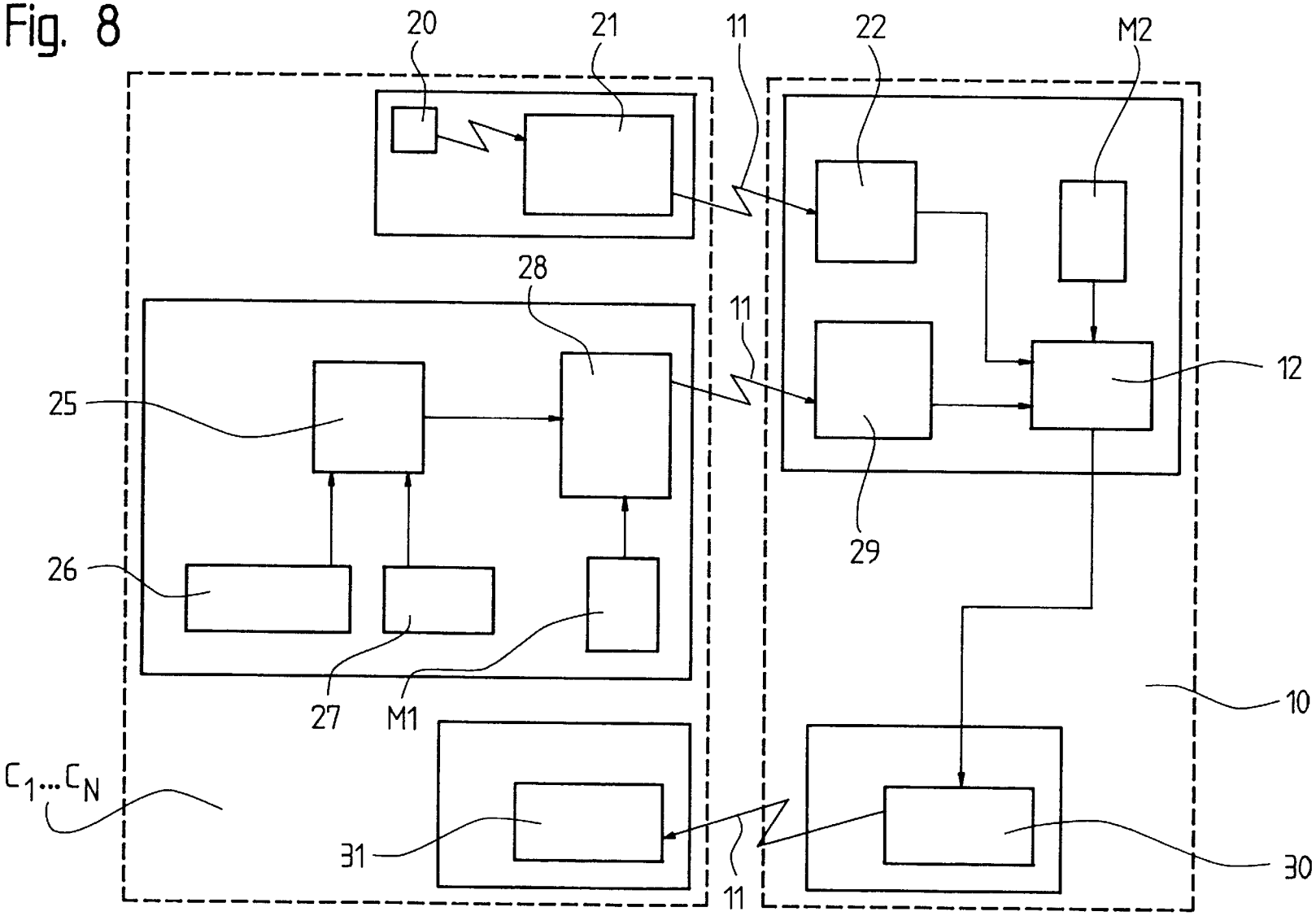
FIG. 8 is a schematic illustration of the components for the safety equipment.

FIG. 8 shows a schematic illustration of the components for the entire safety equipment. All cars C1 . . . CN share the dynamic model shown in FIG. 4 one with the other or each car C1 . . . CN implements the dynamic model in a module M1. Equally, each car C1 . . . CN comprises a safety module 10. The safety is increased substantially by the redundant construction of the safety module 10, since the elevator plant cannot rely on only a single safety module 10. On request of the elevator control 20, a stopping module 21 sends the request to a receiver unit 22. The actual travel data, in particular the car position and speed, are ascertained in a position module 12 on the basis of shaft information data 26 and the information data supplied by a real time clock 27. Position and speed are augmented in a processing unit 28 with the dynamic model from the module M1 and sent to an information unit 25. In the decision module 12, the data from the receiver unit 22 (stop request), the information unit 29 (position and speed) and from a further dynamic model of a module M2 are processed and the braking behavior is fixed. The braking behavior is passed from the decision module 12 to a command generator 30, which produces the stop command. This stop command is communicated to a brake module 31 of the car C1 . . . CN, which is responsible for the passing-on of the command or the initiation of the braking phase.

The travel data of all cars C1 . . . CN are communicated by way of the communications system 11. Each car C1 . . . CN can fix its braking behavior on its own in accordance with the own state and the travel data received from the other cars.

The safety equipment need therefore not rely on a single safety module 10. Each car C1 . . . CN has the possibility of controlling its stopping process itself. Moreover, each car C1 . . . CN can monitor other cars, for example the following one, and initiate an emergency stop when a faulty function occurs in the monitored car C1 . . . CN. By this system furthermore with the aid of the dynamic model, the spacings between the cars C1 . . . CN can be kept as small as possible or as large as necessary in order to ensure an optimum efficiency of the elevator operation.

As variant for the ascertaining of the travel data, sensors can also be used in place of the dynamic model. Sensors, for example infrared sensors, are arranged above and below at each car C1 . . . CN and measure the distances to cars C1 . . . CN situated above and below in the shaft 1. A shaft information system, for example in the form of measuring strips which are arranged in the shafts 1 and scanned by light barriers fastened at the cars C1 . . . CN, can serve for ascertaining the positions of the cars C1 . . . CN. In this manner, the speed and position of each car C1 . . . CN can be ascertained. These travel data are likewise passed on to safety modules 10 and the braking behavior of the cars C1 . . . CN is determined subsequently.

These safety equipments are also applicable to other than automotive multimobile elevator groups, for example to a elevator group in which several cars C1 . . . CN guided at cables in the same shaft 1 operate. Counterweights are arranged as balancing elements at the cable ends. In such a elevator group, each car C1 . . . CN has an own independent drive which is mounted at the counterweight or in a machine room above or below the shafts 1.

The arrangement of the safety modules 10 need not necessarily take place on the cars C1 . . . CN; they can also be accommodated in the machine room or on the floors E1 . . . EN.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Safety equipment for a multimobile elevator group, in which several elevator cars (C1 . . . CN) operate over several floors (E1 . . . EN) at the same time in at least one shaft, wherein each car (C1 . . . CN) is driven by an individual independent drive (2) and provided with an individual brake, characterized in, that at least one safety module (10) computes the necessary braking behavior of the cars (C1 . . . CN) from actual travel data of the cars (C1 . . . CN), in particular the car position and speed, on the basis of stop requests so that collisions between the cars (C1 . . . CN) can be prevented and that preferably each car is provided with an individual safety module (10).

2. Safety equipment according to claim 1, characterized in, that at cars mounted safety modules (10) contain a decision module (12), which determines the braking behavior from the actual travel data and stop requests and is, via a command generator (30), initiating different braking operations, apart from the own car, also at neighboring cars (C1 . . . CN).

3. Safety equipment according to claim 2, characterized in, that the braking operations comprise a normal floor stop to a call, performed by a brake module (31), an emergency stop, caused by a mechanical brake, to secure a stop at a floor, and an engagement of the car-catching device, caused by a not provided emergency situation.

4. Safety equipment according to claim 2, characterized in, that a decision module (12) can prevent a floor stop of a car (C1 . . . CN) in order to prevent a collision with a following car (C1 . . . CN).

5. Safety equipment according to claim 1, characterized in, that a dynamic model M1 of an elevator travel curve D is referred to for the ascertaining of the actual travel data of a car (C1 . . . CN).

6. Safety equipment according to claim 5, characterized in that the ascertaining of the actual travel data takes place by means of sensors arranged on the cars (C1 . . . CN) and a shaft information system (26).

7. Safety equipment according to claim 1, characterized in, that the cars (C1 . . . CN) with safety modules (10) are constructed as vertically and preferably also horizontally automotive passenger transport equipments.

8. Safety equipment according to claim 1, characterized in, that the cars (C1 . . . CN) with safety modules (10) are constructed as cable-guided passenger transport equipments.

9. Safety equipment for a multimobile elevator group, in which at least two elevator cars (C1 . . . CN) operate over several floors (E1 . . . EN) at the same time in at least one shaft, wherein each elevator car is driven by an individual independent drive (2) and provided with an individual brake, the drive and the brake being connected to and operated by an elevator control (20), comprising:

at least one safety module (10) for computing necessary braking behavior of each of the at least two elevator cars (C1 . . . CN) when the elevator cars are travelling in the same shaft at the same time, said safety module being responsive to shaft information data (26) of the elevator cars, in particular the car position and speed, and to stop requests received from the elevator control (20), the stop requests including a normal floor stop to a call, an emergency stop and an engagement of a car-catching device; and a decision module (12) in said safety module (10) and in communication with the elevator car brakes for controlling braking of the elevator cars in response to said computed braking behavior to prevent collisions between the elevator cars.

* * * * *